US005308524A

United States Patent [19]

Miyaji et al.

[11] Patent Number: 5,308,524

[45] Date of Patent: May 3, 1994

[54] LUBRICATING OIL COMPOSITION FOR 2 CYCLE OR ROTARY ENGINE

[75] Inventors: Tomomi Miyaji; Takeshi Matsuoka, both of Ichihara, Japan

[73] Assignee: Idemitsu Kosan Co., Ltd., Tokyo, Japan

[21] Appl. No.: 911,503

[22] Filed: Jul. 10, 1992

[30] Foreign Application Priority Data

Jul. 19, 1991 [JP] Japan ..... 3-179381

[51] Int. Cl.[5] ..... C10M 105/38

[52] U.S. Cl. ..... 252/51.5 A; 252/56 R; 252/56 S; 252/52 R

[58] Field of Search ..... 252/51.5 A, 56 R, 56 S

[56] References Cited

U.S. PATENT DOCUMENTS

| | | | |
|---|---|---|---|
| 4,197,409 | 4/1980 | Lilburn | 252/51.5 A |
| 4,233,168 | 11/1980 | Lewis et al. | 252/51.5 A |
| 4,329,240 | 5/1982 | Lilburn | 252/51.5 A |

FOREIGN PATENT DOCUMENTS

| | | |
|---|---|---|
| 0134014 | 3/1985 | European Pat. Off. . |
| 0297996 | 1/1989 | European Pat. Off. . |
| 0361180 | 4/1990 | European Pat. Off. . |
| 0365081 | 4/1990 | European Pat. Off. . |
| 0468109 | 1/1992 | European Pat. Off. . |
| 3643935 | 6/1988 | Fed. Rep. of Germany . |
| 2498623 | 7/1982 | France . |
| 2-214795 | 8/1990 | Japan . |
| 1361170 | 12/1987 | U.S.S.R. . |
| 967592 | 8/1964 | United Kingdom . |
| 1131925 | 10/1968 | United Kingdom . |
| 8801290 | 2/1988 | World Int. Prop. O. . |

*Primary Examiner*—Ellen M. McAvoy

*Attorney, Agent, or Firm*—Antonelli, Terry, Stout & Kraus

[57] ABSTRACT

Disclosed is a lubricating oil composition for 2 cycle or rotary engine, superior in biodegradability, having sufficiently high miscibility with gasoline and further superior in detergency. The lubricating oil composition is prepared by mixing (A) an ester of hindered alcohol and fatty acid having 5 to 14 carbon atoms and (B) either or both of a poly (oxyalkylene) aminocarbamate and an alkenylsuccinimide, or to them adding (C) either or both of a hydrocarbon having a boiling point of 500° C. or below and an aromatic content of 2% or below and an ether having an aromatic content of 2% or below and 6 to 20 carbon atoms.

12 Claims, No Drawings

LUBRICATING OIL COMPOSITION FOR 2 CYCLE OR ROTARY ENGINE

BACKGROUND OF THE INVENTION

1. Field of the Invention

The present invention relates to a lubricating oil composition for 2 cycle or rotary engine. More particularly it relates to a lubricating oil composition which is superior in biodegradability and has sufficiently high miscibility with gasoline and further is superior in detergency.

2. Description of the Related Arts

Hitherto, there have been demands for the development of lubricating oils superior in biodegradability from the view point of environmental protection. It has been known that several ester compounds are very suitable for this purpose (c.f. Power Design, Vol. 28 (7), p. 65, etc.). However, if these compounds are used as lubricant for 2 cycle or rotary engines, resulting detergency would not be sufficiently high, leaving their use an open question. Furthermore, the ester compounds have insufficient miscibility with gasoline and occasionally give rise to a failure of lubrication.

SUMMARY OF THE INVENTION

From the standpoint of these circumstances, the present inventors have made intensive studies with a view to developing a composition which is superior in biodegradability and has sufficiently high miscibility with gasoline and further is superior in detergency, suitable as a lubricating oil for use in 2 cycle or rotary engine. As a result, a series of esters derived from the sterically hindered alcohols and the selected carboxylic acids, or the mixture thereof with poly(oxyalkylene) aminocarbamate and/or alkenylsuccinimide and, if desirable, further adding thereto the hydrocarbons and/or the ethers having low aromatic content, has been found to have the preferable lubrication properties required for the environmental protection. The present invention has been completed on the basis of this finding.

An object of the present invention is to provide a lubricating oil composition which is superior in biodegradability and has sufficiently high miscibility with gasoline and further superior in detergency.

Another object of the present invention is to provide a lubricating oil composition which can be widely and effectively used in the lubrication of 2 cycle or rotary engines, particularly automobile 2 cycle engine, outboard engine, leisure boat engine, multi-purpose 2 cycle engine (chain saw, generator, mower) and the like.

The present invention provides a lubricating oil composition for use in a 2 cycle or rotary engine which comprises (A) an ester formed by a hindered alcohol and a fatty acid having 5 to 14 carbon atoms (component (A)) and (B) either or both of a poly (oxyalkylene) aminocarbamate and an alkenylsuccinimide (component (B)) as the essential component.

The present invention also provides a lubricating oil composition which comprises the components (A) and (B) and (C) either or both of a hydrocarbon having a boiling point of 500° C. or below and an aromatic content of 2% or below and an ether having an aromatic content of 2% or below and 6 to 20 carbon atoms (component (C)) as the essential component.

DESCRIPTION OF PREFERRED EMBODIMENTS

In the composition of the present invention, the (A) component is an ester formed by a hindered alcohol and a fatty acid having 5 to 14 carbon atoms, and various hindered alcohols can be used herein. Preferred among them are a trimethylolpropane, a dehydrated dimer of trimethylolpropane, a dimer of trimethylolpropane crosslinked by dibasic acid, a pentaerythritol, a dehydrated dimer of pentaerythritol, a dimer of pentaerythritol crosslinked by dibasic acid, a neopentylglycol, a dehydrated dimer of neopentylglycol or a dimer of neopentylglycol crosslinked by dibasic acid. As the dibasic acid, adipic acid and sebacic acid are preferably used.

According to the present invention, the fatty acid constituting the ester with the hindered alcohol has carbon atoms ranging from 5 to 14, preferably 6 to 12, either straight or branched chain, saturated or unsaturated, but, particularly preferable is monobasic acid. A fatty acid having 4 carbon atoms or less has a low viscosity, undesirably leading to a decrease in discharge efficiency of the pump for separate oiling system and a failure in the feeding of lubricating oil. On the other hand, when the fatty acid has 15 carbon atoms or more, the lubricating oil is not sufficiently miscible with gasoline at low temperatures, causing a failure of lubrication.

Further, detergency of the piston and biodegradability are undesirably reduced.

Of said hindered alcohols, those particularly preferred include trimethylolpropane, pentaerythritol and neopentylglycol. Of the fatty acids, those particularly preferred include a compound from among straight or branched chain fatty acids having 5 to 12 carbon atoms or their two or more combination.

Particularly, most suitable is an ester formed of a combination of these hindered alcohols and fatty acids, having a total acid value of 1 or below and a hydroxyl value of 30 or below.

Specific examples of the esters as the (A) component include (1) an ester of a neopentylglycol and a branched chain fatty acid having 8 to 10 carbon atoms, (2) an ester of a trimethylolpropane and a branched chain fatty acid having 8 to 10 carbon atoms, (3) an ester of a pentaerythritol, a branched chain fatty acid having 6 to 10 carbon atoms and a straight chain fatty acid having 8 to 12 carbon atoms, (4) an ester of a pentaerythritol and a straight chain fatty acid having 5 to 8 carbon atoms, (5) an ester of a neopentylglycol and a branched chain fatty acid having 8 to 14 carbon atoms and (6) an ester of a dipentaerythritol, a branched chain fatty acid having 5 to 8 carbon atoms and a straight chain fatty acid having 5 to 8 carbon atoms.

The mixing ratio of said component (A) is not particularly limited and can be selected suitably depending upon circumstances, but ordinarily the component (A) is mixed in an amount of 40 to 99.9% by weight, preferably 50 to 98% by weight, based on the lubricating oil as a whole.

When the mixing ratio of the (A) component is too low, biodegradability of the lubricating oil is decreased. On the other hand when it is too great, detergency of the piston occasionally is decreased.

In the composition of the present invention, the (B) component is either or both of poly (oxyalkylene) aminocarbamate and alkenylsuccinimide. This (B) component is an ashless dispersant for gasoline, and a variety of poly (oxyalkylene) aminocarbamates can be used but it is preferably to use those represented by the general formula:

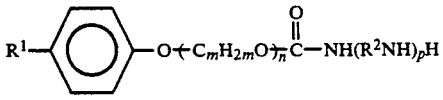

wherein $R^1$ is an alkyl group having 8 to 30 carbon atoms, preferably an alkyl group having 10 to 25 carbon atoms; $R^2$ is an alkylene group having 1 to 6 carbon atoms; m is an integer of 1 to 8, preferably an integer of 2 to 5; n is an integer of 10 to 40, preferably an integer of 15 to 35; and p is an integer of 1 or 2. The alkenylsuccinimides include a polybutenylsuccinimide having a polybutenyl group with a molecular weight of 100 to 2000.

The mixing ratio of said (B) component is not particularly limited and can be selected properly depending upon circumstances, but ordinarily the (B) component is mixed in an amount of 0.1 to 30% by weight, preferably 0.1 to 10% by weight based on the lubricating oil. When the mixing ratio of the (B) component is too low, it is not possible to improve detergency sufficiently in parts installed at the position of relatively low temperature, such as piston-undercrown and ball bearing at the small end part of con rod. On the other hand, when it is too great, detergency thereof is decreased by contraries. Furthermore, to improve the lubrication properties of the composition in the present invention, various known additives may as well be effectively incorporated in an amount of 20% by weight or below.

The composition of the present invention comprises said (A) and (B) components as the essential component, but either or both of a hydrocarbon having a boiling point of 500° C. or below and an aromatic content of 2% or below and an ether having an aromatic content of 2% or below and 6 to 20 carbon atoms can be incorporated into the composition as a further (C) component. As used herein, the aromatic content means a value obtained with the measurement according to ASTM D 1319-89.

Said hydrocarbon has a boiling point of 500° C. or below preferably 150° to 450° C. and an aromatic content of 2% or below, preferably 1% or below and is a liquid at ordinary temperature. The hydrocarbon that satisfies the above requirements includes a hydrogenated light mineral oil such as hydrogenated kerosene, light oil and the like, preferably a polymer of ethylene, propylene or butene (tetramer to decamer of ethylene, trimer to octamer of propylene and dimer to hexamer of butene) and a copolymer thereof. Addition of the hydrocarbon that has the boiling point higher than 500° C. decreases the improving effect for the miscibility of the composition with gasoline, and the hydrocarbon that contains an aromatic content of more than 2% adversely affect the microorganisms for decomposing oil, and accordingly lowers the biodegradation of the composition significantly. The ether as the (C) component is a synthetic ether having an aromatic content of 2% or below, preferably 1% or below and 6 to 20 carbon atoms, preferably 6 to 10 carbon atoms. This ether include diisoamyl ether, diisopropyl ether and dibutyl ether. Addition of the ether that has more than 20 carbon atoms decreases the improving effect for the miscibility of the composition with gasoline, and the ether that contains an aromatic content of more than 2% adversely affect the microorganisms for decomposing oil, and accordingly lowers the biodegradation of the composition significantly.

The mixing ratio of said (C) component in the composition is not particularly limited and can be selected properly depending upon circumstances, but usually the (C) component is mixed in an amount of 60% by weight or below, particularly preferably 1 to 50% by weight based on the total weight of the lubricating oil composition. The (C) component is effective for improving miscibility between the composition of the present invention and gasoline, but when its mixing ratio is too great, biodegradability is decreased.

As described above, the composition of the present invention comprises the (A) and (B) components as the essential component or the (A), (B) and (C) components as the essential component, but various known additives as described above can be incorporated into the composition, if desirable. Further, polybutene and the like can be effectively mixed into the composition at ratio of 40% by weight or below based on the total weight of the lubricating oil.

The kinematic viscosity of the composition of the present invention is not particularly limited and can be selected properly depending upon circumstances. However, ordinarily the kinematic viscosity in a range of 20 to 150 cSt (40° C.) is preferable.

As obvious from the above, the lubricating oil composition of the present invention is superior in biodegradability and has sufficiently high miscibility with gasoline and further superior in detergency.

Accordingly the lubricating oil composition of the present invention can be widely and effectively used in the lubrication of 2 cycle or rotary engines, particularly automobile 2 cycle engine, outboard engine, leisure boat engine, multi-purpose 2 cycle engine (chain saw, generator, mower) and the like Now, the present invention will be described in greater detail with reference to examples and comparative examples.

EXAMPLES 1 TO 12 AND COMPARATIVE EXAMPLES 1 TO 8

The lubricating oil compositions were prepared by mixing the components listed in Table 1 at the predetermined ratios and evaluated for their physical properties according to the following methods. The results are shown in Table 1.

Testing Method for Evaluation (1) Biodegradability

It was tested according to the testing method provided for in the CEC specification (CEC L-33-T82).

(2) Miscibility with gasoline

It was tested at −25° C. according to the testing method provided for in the ASTM specification (ASTM 4682-87).

(3) Detergency of the piston

An air-cooling, single 50 cc cylinder-2 cycle engine was operated for 1 hour under the conditions of an engine revolution of 6500 rpm, a full load, the ratio of fuel to lubricating oil of 20:1 and a plug washer temperature of 270° C.

Six positions of the engine, i.e., top ring, 2nd ring, top land, 2nd land, piston skirt and undercrown, were observed, the result of each observation was evaluated on a maximum of 10 points and the obtained points were footed up to make a synthetic evaluation mark (worst: 0 point, best: 60 points).

TABLE 1

| Blending Ratio of Components in Lubricating Oil Composition (wt %) | Examples 1 | 2 | 3 | 4 | 5 | 6 | 7 | 8 | 9 | 10 | 11 | 12 |
|---|---|---|---|---|---|---|---|---|---|---|---|---|
| (A) component: | | | | | | | | | | | | |
| Hindered ester(1)*1 | 70 | 75 | 90 | 90 | — | — | 90 | 90 | 82 | 53 | — | 98 |
| Hindered ester(2)*2 | — | — | — | — | 90 | — | — | — | — | — | — | — |
| Hindered ester(3)*3 | — | — | — | — | — | 90 | — | — | — | — | 58 | — |
| (C) component: | | | | | | | | | | | | |
| Tetramer of butene | 10 | 10 | 8 | 8 | 8 | 8 | — | — | 16 | 5 | — | — |
| Octamer of ethylene | — | — | — | — | — | — | 8 | — | — | — | 40 | — |
| Hydrogenated kerosene | — | — | — | — | — | — | — | 8 | — | — | — | — |
| (B) component: | | | | | | | | | | | | |
| Polyoxyalkylene aminocarbamate(1)*4 | 2 | 2 | 2 | — | 2 | 2 | 2 | 2 | 2 | 2 | 2 | 2 |
| Polyoxyalkylene aminocarbamate(2)*5 | — | — | — | 2 | — | — | — | — | — | — | — | — |
| Other Components | | | | | | | | | | | | |
| Hindered ester(4)*6 | — | — | — | — | — | — | — | — | — | — | — | — |
| Hindered ester(5)*7 | — | — | — | — | — | — | — | — | — | — | — | — |
| Dibasic acid ester*8 | — | — | — | — | — | — | — | — | — | — | — | — |
| Paraffinic mineral oil(500N) | — | — | — | — | — | — | — | — | — | — | — | — |
| 10% aromatic kerosene | — | — | — | — | — | — | — | — | — | — | — | — |
| Polybutene(Mw = 900) | 13 | 13 | — | — | — | — | — | — | — | 40 | — | — |
| Isostearic acid amide | 5 | — | — | — | — | — | — | — | — | — | — | — |
| Physical Properties and Performance | | | | | | | | | | | | |
| Kinematic viscosity(40° C.) (cSt) | 53.7 | 52.1 | 32.5 | 32.1 | 27.9 | 45.0 | 43.8 | 33.3 | 20.9 | 142 | 20.2 | 41.5 |
| (1) Biodegradability(%) | 77 | 86 | 83 | 93 | 91 | 89 | 93 | 87 | 89 | 69 | 89 | 96 |
| (2) Miscibility with gasoline | Pass | Pass | Pass | Pass | Pass | Pass | Pass | Pass | Pass | Pass | Pass | Pass |
| (3) Detergency of the piston (0:worst, 60:best) | 47.1 | 42.3 | 41.0 | 40.1 | 41.2 | 41.8 | 40.5 | 40.6 | 42.3 | 39.8 | 42.3 | 39.6 |

| Blending Ratio of Components in Lubricating Oil Composition (wt %) | Comparative Example 1 | 2 | 3 | 4 | 5 | 6 | 7 | 8 |
|---|---|---|---|---|---|---|---|---|
| (A) component: | | | | | | | | |
| Hindered ester(1)*1 | 100 | 90 | 70 | — | — | — | — | 90 |
| Hindered ester(2)*2 | — | — | — | — | — | — | — | — |
| Hindered ester(3)*3 | — | — | — | — | — | — | — | — |
| (C) component: | | | | | | | | |
| Tetramer of butene | — | 10 | 12 | 8 | 20 | 10 | 10 | — |
| Octamer of ethylene | — | — | — | — | — | — | — | — |
| Hydrogenated kerosene | — | — | — | — | — | — | — | — |
| (B) component: | | | | | | | | |
| Polyoxyalkylene aminocarbamate(1)*4 | — | — | — | 2 | 2 | 2 | 2 | 2 |
| Polyoxyalkylene aminocarbamate(2)*5 | — | — | — | — | — | — | — | — |
| Other Components | | | | | | | | |
| Hindered ester(4)*6 | — | — | — | 90 | — | — | — | — |
| Hindered ester(5)*7 | — | — | — | — | 78 | — | — | — |
| Dibasic acid ester*8 | — | — | — | — | — | 70 | — | — |
| Paraffinic mineral oil(500N) | — | — | — | — | — | — | 88 | — |
| 10% aromatic kerosene | — | — | — | — | — | — | — | 8 |
| Polybutene(Mw = 900) | — | — | 13 | — | — | 13 | — | — |
| Isostearic acid amide | — | — | 5 | — | — | 5 | — | — |
| Physical Properties and Performance | | | | | | | | |
| Kinematic viscosity(40° C.) (cSt) | 39.9 | 26.3 | 50.1 | 11.2 | 38.7 | 38.1 | 46.3 | 30.2 |
| (1) Biodegradability(%) | 98 | 94 | 78 | 93 | 59 | 62 | 48 | 42 |
| (2) Miscibility with gasoline | Pass | Pass | Pass | Pass | Rej. | Pass | Pass | Pass |
| (3) Detergency of the piston (0:worst, 60:best) | 23.8 | 25.9 | 28.8 | Seiz. | 24.3 | 19.8 | 22.7 | 40.4 |

*1Pentaerythritol + iso-$C_8$ monobasic fatty acid + n-$C_{10}$ monobasic fatty acid
*2Neopentylglycol + iso-$C_9$ monobasic fatty acid
*3Trimethylolpropane + iso-$C_9$ monobasic fatty acid

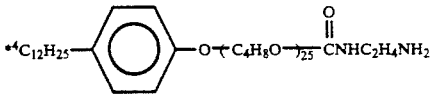

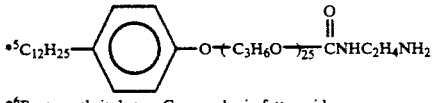

*6Pentaerythritol + n-$C_3$ monobasic fatty acid
*7Neopentylglycol + iso-$C_{16}$ monobasic fatty acid
*8Adipic acid + iso $C_{13}$ monobasic alcohol It is evident from the results shown in Table 1 that when the (A) component was used singly as the lubricant, detergency of the piston was poor (Comparative Example 1), that when the (B) component was missing, detergency of the piston also was poor (Comparative Example 2) and further that even when the (B) component was missing but a known detergent was added, detergency of the piston was poor (Comparative Example 3). Moreover, when the fatty acid as the (A) component has an alkyl group of shorter carbon chain, the seizure was liable to occur (Comparative Example 4). On the other hand, when the fatty acid has an alkyl group of longer chain, biodegradability and detergency were poor (Comparative Example 5). When the (A) component was an dibasic acid ester, detergency of the piston was poor even on addition of a detergent and further biodegradability was poor as well (Comparative Example 6). In the case where the (A) component was a paraffinic mineral oil, detergency of the piston and biodegradability were poor (Comparative Example 7), while the use of a kerosene having a high aromatic content as the (C) component resulted in a reduction of biodegradability (Comparative Example 8).

What is claimed is:

1. A lubricating oil composition for a two-cycle or rotary engine, comprising (A) an ester of a hindered alcohol and a fatty acid having 5 to 14 carbon atoms, (B) at least one compound of a poly(oxyalkylene) aminocarbamate and an alkenylsuccinimide, and (C) at least one compound of a hydrogenated light mineral oil with a boiling point of 150° to 450° C. and an aromatic content of 2% or below, a polymer of ethylene, propylene or butene and a copolymer thereof, and an ether having an aromatic content of 2% or below and 6 to 20 carbon atoms as the essential component.

2. A composition according to claim 1, wherein the hindered alcohol is a trimethylolpropane, a dehydrated dimer of trimethylolpropane, a dimer of trimethylolpropane crosslinked by dibasic acid, a pentaerythritol, a dehydrated dimer of pentaerythritol, a dimer of pentaerythritol crosslinked by dibasic acid, a neopentylglycol, a dehydrated dimer of neopentylglycol, or a dimer of neopentylglycol crosslinked by dibasic acid.

3. A composition according to claim 2, wherein the fatty acid is a compound having straight or branched chain with 5 to 12 carbon atoms.

4. A composition according to claim 1, wherein the fatty acid is a compound having straight or branched chain with 5 to 12 carbon atoms.

5. A composition according to claim 1, wherein (A) the ester is (1) an ester of a neopentylglycol and a branched chain fatty acid having 8 to 10 carbon atoms, (2) an ester of a trimethylolpropane and a branched chain fatty acid having 8 to 10 carbon atoms, (3) an ester of a pentaerythritol, a branched chain fatty acid having 6 to 10 carbon atoms and a straight chain fatty acid having 8 to 12 carbon atoms, (4) an ester of a pentaerythritol and a straight chain fatty acid having 5 to 8 carbon atoms, (5) an ester of a neopentylglycol and a branched chain fatty acid having 8 to 14 carbon atoms or (6) an ester of a dipentaerythritol, a branched chain fatty acid having 5 to 8 carbon atoms and a straight chain fatty acid having 5 to 8 carbon atoms.

6. A composition according claim 5, wherein (B) the poly(oxyalkylene)aminocarbamate is a poly(oxyalkylene)aminocarbamate represented by the general formula:

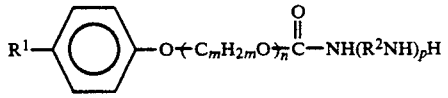

wherein $R^1$ is an alkyl group having 8 to 30 carbon atoms; $R^2$ is an alkylene group having 1 to 6 carbon atoms; m is an integer of 1 to 8, preferably an integer of 2 to 5; n is an integer of 10 to 40, preferably an integer of 15 to 35; and p is an integer of

7. A composition according claim 1, wherein (B) the poly(oxyalkylene)aminocarbamate is a poly(oxyalkylene)aminocarbamate represented by the general formula:

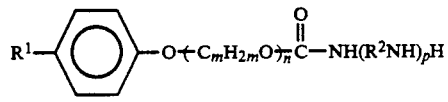

wherein $R^1$ is an alkyl group having 8 to 30 carbon atoms; $R^2$ is an alkylene group having 1 to 6 carbon atoms; m is an integer of 1 to 8, preferably an integer of 2 to 5; n is an integer of 10 to 40, preferably an integer of 15 to 35; and p is an integer of 1 or 2.

8. A composition according to claim 1, wherein (C) the hydrocarbon is a hydrogenated light mineral oil having a boiling point of 150° to 450° C. and an aromatic content of 2% or below and being a liquid at ordinary temperature.

9. A composition according to claim 1, wherein (C) the hydrocarbon is an ethylene polymer in a range of tetramer to decamer, a propylene polymer in a range of trimer to octamer and a butene polymer in a range of dimer to hexamer or a copolymer of these compounds.

10. A composition according to claim 6, wherein (C) the hydrocarbon is a hydrogenated light mineral oil having a boiling point of 150° to 450° C. and an aromatic content of 2% or below and being a liquid at ordinary temperature.

11. A composition according to claim 6, wherein (C) the hydrocarbon is an ethylene polymer in a range of a tetramer to decamer, a propylene polymer in the range of trimer to octamer and a butene polymer in a range of dimer to hexamer or a copolymer of these compounds.

12. A composition according to claim 1, wherein the amount of component (A) is 40 to 99% by weight, the amount of component (B) is 0.1 to 30% by weight and the amount of component (C) is 1 to 50% by weight, each amount being based on the total weight of the lubricating oil composition.

* * * * *